United States Patent [19]

Iwakura et al.

[11] Patent Number: 4,920,091

[45] Date of Patent: Apr. 24, 1990

[54] RECORDING MATERIAL

[75] Inventors: Ken Iwakura; Shojiro Sano; Masato Satomura; Koreshige Ito; Katsumi Matsuoka, all of Shizuoka, Japan

[73] Assignee: Fuji Photo Film Co., Ltd., Kanagawa, Japan

[21] Appl. No.: 290,669

[22] Filed: Dec. 27, 1988

[30] Foreign Application Priority Data

| | | | |
|---|---|---|---|
| Dec. 25, 1987 | [JP] | Japan | 62-329268 |
| Mar. 14, 1988 | [JP] | Japan | 63-59919 |
| Mar. 14, 1988 | [JP] | Japan | 63-59920 |
| Jul. 8, 1988 | [JP] | Japan | 63-170546 |

[51] Int. Cl.[5] ..... B41M 5/16; B41M 5/18; B41M 5/20

[52] U.S. Cl. ..... 503/211; 427/150; 503/212; 503/216; 503/225

[58] Field of Search ..... 427/150; 428/913, 914; 503/216, 217, 225, 211, 212

[56] References Cited

U.S. PATENT DOCUMENTS 3,965,282 6/1976 Janssens et al. ..... 503/216

*Primary Examiner*—Bruce H. Hess

*Attorney, Agent, or Firm*—Sughrue, Mion, Zinn, Macpeak & Seas

[57] ABSTRACT

A recording medium comprising at least one electron donating colorless dye and at least one electron accepting compound, wherein the electron accepting compound is a salicylic acid compound represented by formula (I):

(I)

wherein R represents a divalent group; X and Y, which may be the same or different, each represents a hydrogen aotm, an alkyl group, an aryl group, an alkoxy group, or a halogen atom; and Z represents a hydrogen atom, a carboxyl group, an alkyl group, an aryl group, an alkoxy group, or a halogen atom, or a metal salt thereof.

13 Claims, No Drawings

RECORDING MATERIAL

FIELD OF THE INVENTION

The present invention relates to a recording material utilizing a color formation reaction between an electron donating colorless dye and an electron accepting compound, and more particularly to a recording material having improved color developability and providing a color image having improved stability.

BACKGROUND OF THE INVENTION

Recording materials using a combination of an electron donating colorless dye (hereinafter, referred to as "color former") and an electron accepting compound (hereinafter, referred to as "color developer") are well known for use as a pressure-sensitive paper, heat-sensitive paper, light- and pressure-sensitive paper, electric heat-sensitive paper, heat-sensitive transfer paper, and the like. The details for these recording materials are described, e.g., in U.S. Pat Nos. 2,505,470, 2,505,489, 2,550,471, 2,548,366, 2,712,507, 2,730,456, 2,730,457, and 3,418,250, JP-A-49-28411 and JP-A-50-44009 (the term "JP-A" as used herein means an "unexamined published Japanese patent application"), British Pat. No. 2,140,449, U.S. Pat. Nos. 4,480,052 and 4,436,920, JP-B-60-23922 (the term "JP-B" as used herein means an "examined published Japanese patent application"), and JP-A-57-179836, JP-A-60-123556, and JP-A-60-123557.

These recording materials are required to (1) provide an image having sufficient color density with sufficient color formation sensitivity, (2) cause no fog, (3) provide an image having sufficient fastness, (4) form a hue suited for copying machines, (5) have a high S/N ratio, and (6) provide an image sufficiently resistant to chemicals, and the like. Recent studies have been directed particularly to improvements on the characteristics (1) and (3) above.

However, the conventional recording materials have various problems which may seriously impair their commercial value.

For example, when a pressure-sensitive recording material is preserved in files made of, for example, vinyl chloride, the recorded area undergoes color disappearance due to the action of a plasticizer, etc.

Heat-sensitive recording materials undergo fog upon contact with solvents, etc., and these materials undergo decoloration or discoloration of the recorded area upon contact with fats and oils, chemicals, etc. Namely, when the heat-sensitive recording material makes contact with stationery which contains materials such as aqueous or oily inks, fluorescent inks, stamp inks, adhesives, starch paste, diazo developers, etc., or cosmetics, such as hand creams, emulsions, etc., the white background tends to undergo fogging or the color developed area tends to be discolored.

The inventors researched both color formers and color developers in pursuit of a satisfactory recording material. In observing the use of color formers and color developers, the inventors focussed their attention upon (1) solubility in oil or water, (2) partition coefficient, (3) pKa, (4) polarity of substituents, (5) position of substituents, and (6) change in crystallizability and solubility when color formers and color developers are used in combination, etc.

SUMMARY OF THE INVENTION

One object of the present invention is to provide a recording material which satisfies high recording requirements such as color developability and image preservability.

The present inventors have found that this and other objects, which will be apparent from the specification, can be accomplished by using a compound represented by formula (I) shown below as a color developer.

The present invention relates to a recording material utilizing the color formation reaction between an electron donating colorless dye and an electron accepting compound. Specifically, the present invention provides a recording material comprising at least one electron donating colorless dye and at least one electron accepting compound, wherein the electron accepting compound is a salicylic acid compound of the following formula (I) or a metal salt thereof.

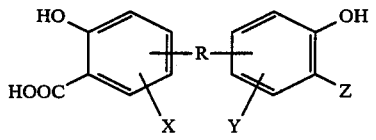

(I)

In the above formula (I), R represents a divalent group; X and Y, which may be the same or different, each represents a hydrogen atom, an alkyl group, an aryl group, an alkoxy group, or a halogen atom; and Z represents a hydrogen atom, a carboxyl group, an alkyl group, an aryl group, an alkoxy group, or a halogen atom.

DETAILED DESCRIPTION OF THE INVENTION

In formula (I), the divalent group represented by R can be selected from the group consisting of

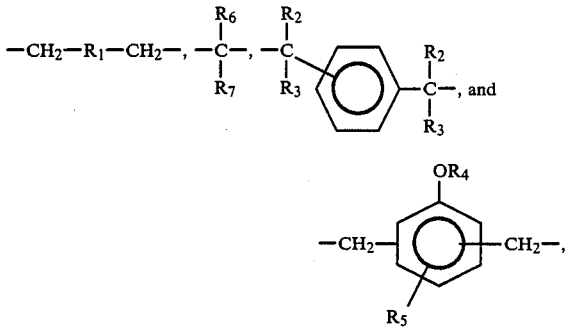

wherein $R_1$ represents a divalent group; $R_2$ and $R_3$ each represents a hydrogen atom, an alkyl group, or an aryl group, provided that $R_2$ and $R_3$ do not simultaneously represent a hydrogen atom; $R_4$ represents a hydrogen atom or an organic residual group; $R_5$ represents a hydrogen atom, an alkyl group, an alkoxy group, an aryl group or a halogen atom, and $R_6$ and $R_7$ each represents a hydrogen atom, an alkyl group, or an aryl group, provided that $R_6$ and $R_7$ do not simultaneously represent a hydrogen atom, and when $R_6$ and $R_7$ simultaneously represent a methyl group, X and Y do not simultaneously a hydrogen atom and t-alkyl group.

Of the compounds represented by formula (I), preferred are those represented by formula (I'):

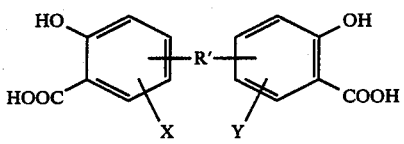

(I')

wherein X and Y are as defined above; and R' represents a divalent group containing 8 or more carbon atoms and an aromatic ring. More preferably, R' is selected from the group consisting of;

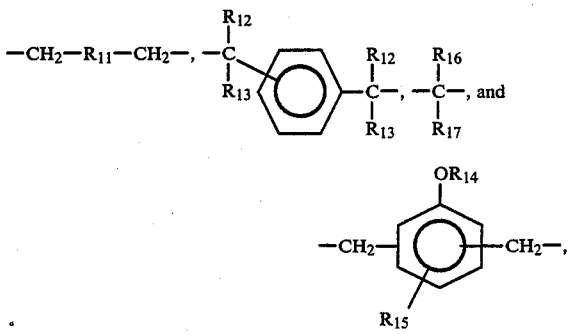

wherein $R_{11}$ represents

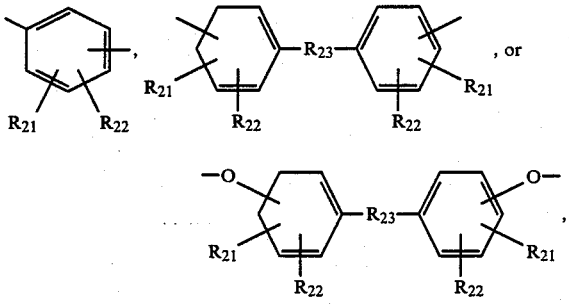

wherein $R_{21}$ and $R_{22}$, which may be the same or different, each represents a hydrogen atom, an alkyl group, an alkoxy group, a halogen atom, an aryl group, or a hydroxyl group; and $R_{23}$ represents an alkylene group or an aralkylene group; $R_{12}$ and $R_{13}$ have the same meaning as $R_2$ and $R_3$; $R_{16}$ and $R_{17}$ each represents a hydrogen atom, an alkyl group, or an aryl group, provided that at least one of $R_{16}$ or $R_{17}$ is an aryl group and that the sum of the number of carbon atoms in $R_{16}$ plus the number of carbon atoms in $R_{17}$ is 7 or more; $R_{14}$ has the same meaning as $R_4$; and $R_{15}$ has the same meaning as $R_5$.

In formulae (I) and (I'), X and Y each preferably represents a hydrogen atom, an alkyl group having from 1 to 18 carbon atoms, an alkoxy group having from 1 to 20 carbon atoms, a phenyl group, a chlorine atom, or a fluorine atom.

Specific examples of the group represented by X and Y include a hydrogen atom, an alkyl group (for example, methyl, ethyl, propyl, butyl, isobutyl, t-butyl, t-amyl, t-hexyl, cyclohexyl, t-octyl, t-nonyl, t-dodecyl, cyclohexylcyclohexyl, cyclohexylmethyl, benzyl, α-methylbenzyl, α,α-dimethylbenzyl, α-tolylethyl, α-tolylisopropyl, benzylbenzyl), a phenyl group, a chlorine atom, and a fluorine atom.

In formula (I'), $R_{11}$ is preferably selected from the group consisting of;

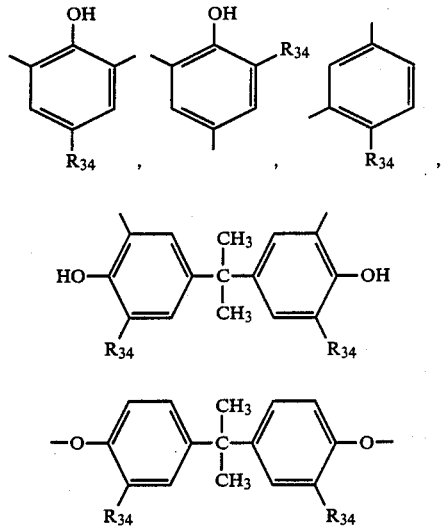

wherein $R_{34}$ represents a hydrogen atom, an alkyl group, an aryl group, or a halogen atom.

$R_{12}$ and $R_{13}$ each preferably represents a hydrogen atom, an alkyl group having from 1 to 8 carbon atoms, or an aryl group having from 6 to 12 carbon atoms, provided that they do not simultaneously represent a hydrogen atom.

$R_{16}$ and $R_{17}$ each preferably represents a hydrogen atom, an alkyl group having from 1 to 8 carbon atoms, or a phenyl group having from 6 to 12 carbon atoms, provided that at least one of $R_{16}$ or $R_{17}$ is an aryl group and that the sum of the number of carbon atoms in $R_{16}$ plus number of carbon atoms in $R_{17}$ is 7 or more.

The organic residue as represented by $R_{14}$ preferably is a hydrogen atom, a substituted or unsubstituted alkyl group having from 1 to 30 carbon atoms, or a substituted or unsubstituted aryl group having from 6 to 20 carbon atoms. When $R_{14}$ is an alkyl group, $R_{14}$ can be saturated or unsaturated or cyclic, and may be substituted with an aryl group, an alkoxy group, an aryloxy group, an acyloxy group, a halogen atom, an acylamino group, an aminocarbonyl group, a cyano group, etc. When $R_{14}$ is an aryl group, $R_{14}$ can be a phenyl group, a naphthyl group, or a heterocyclic group, each of which may be substituted with an alkyl group, an alkoxy group, an aryloxy group, a halogen atom, a nitro group, a cyano group, a substituted carbamoyl group, a substituted sulfamoyl group, a substituted amino group, a substituted oxycarbonyl group, a substituted oxysulfonyl group, a thioalkoxy group, an arylsulfonyl group, a phenyl group, etc.

$R_{14}$ is preferably a straight chain or branched alkyl group having from 1 to 20 carbon atoms, an aralkyl group, or an aryloxyalkyl group.

$R_{15}$ preferably represents a hydrogen atom, an alkyl group having from 1 to 18 carbon atoms, an alkoxy group having from 1 to 20 carbon atoms, a phenyl group, or a chlorine atom.

The metal salt of the salicylic acid compounds of formula (I) is preferably a zinc salt, an aluminum salt, a magnesium salt, a calcium salt, a sodium salt, a nickel salt, or a cobalt. From the standpoint of color developability, the metal salt of the compounds of formulae (I) and (I') preferably has 26 or more carbon atoms.

In formulae (I) and (I'), R and R' are preferably at the meta-position with respect to the carboxyl group of the respective salicylic acid skeleton.

The salicylic acid compound of formula (I) wherein R is $—CH_2—R_1—CH_2—$ can be easily obtained by reacting a salicylic acid compound having, for example, a chloromethyl group with a phenol compound.

specific but non-limiting examples of these salicylic acid compounds are shown below by Compounds (1) to (13):

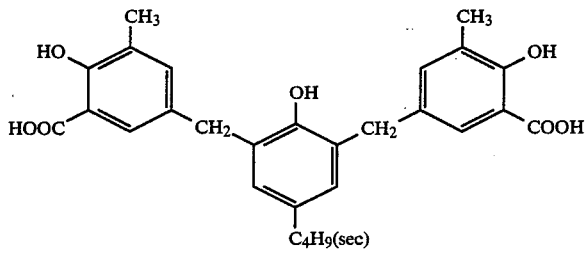

(1)

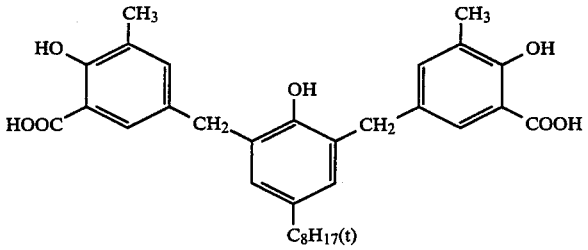

(2)

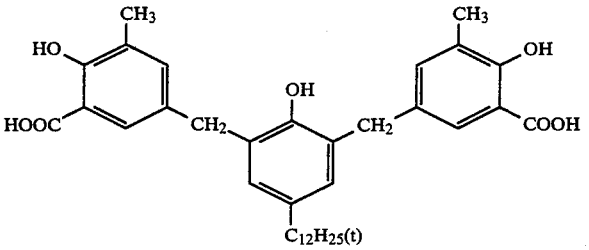

(3)

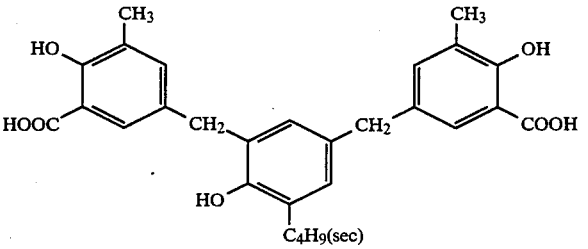

(4)

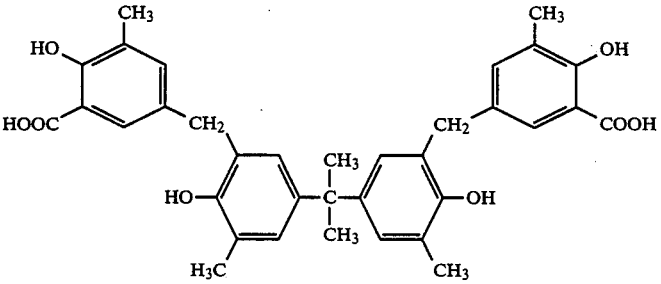

(5)

-continued
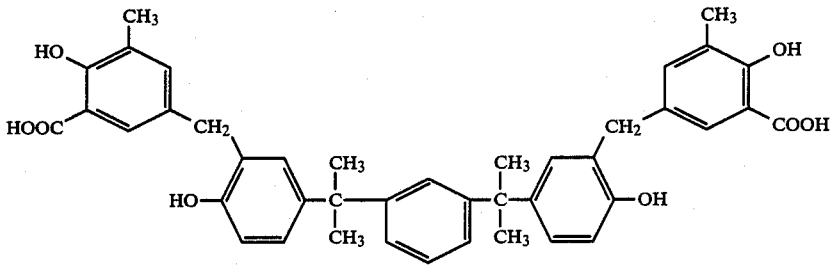
(6)
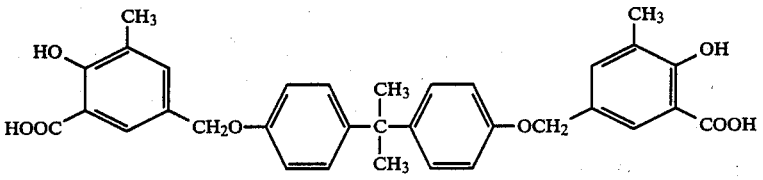
(7)
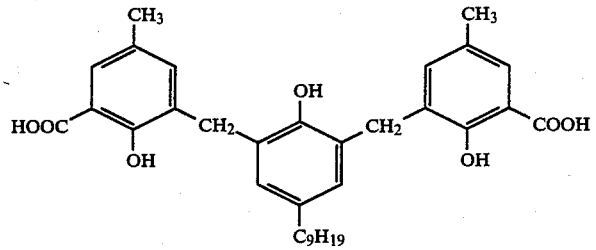
(8)
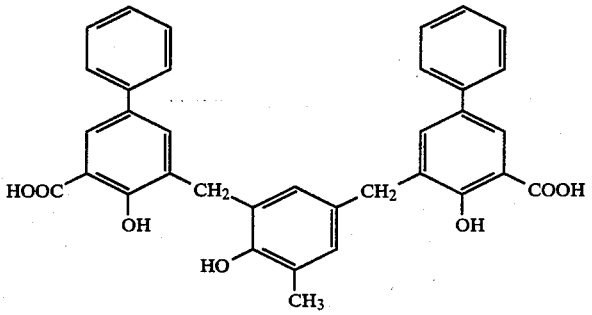
(9)
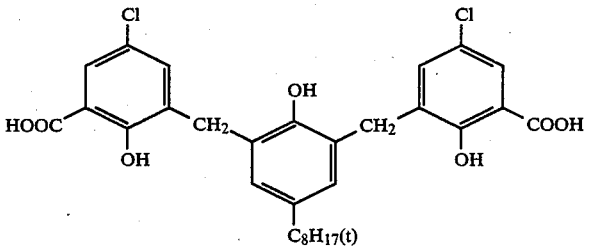
(10)
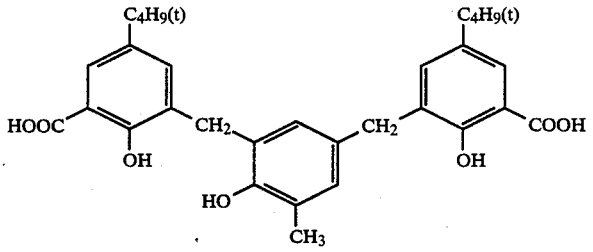
(11)

-continued (12)

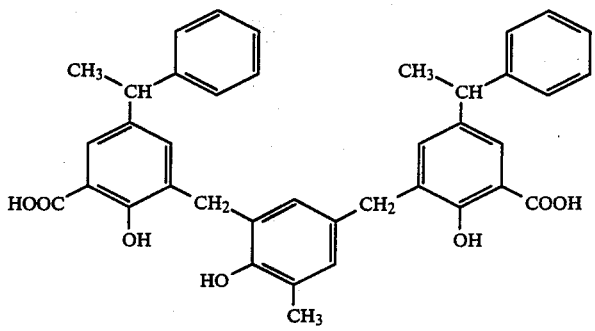

(13)

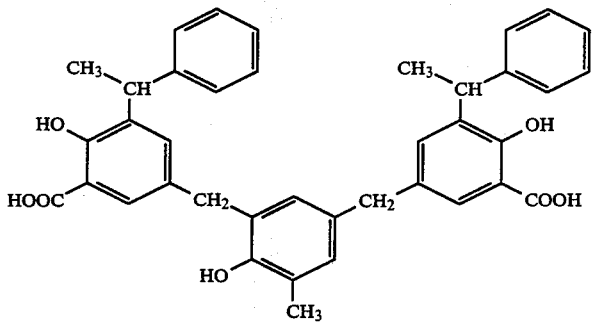

The salicylic acid compounds of formula (I) wherein R is

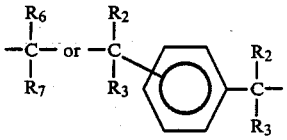

can be synthesized by subjecting the corresponding bisphenol compound to a Kolbe-Schmitt reaction. It is preferable to use a bisphenol compound having a melting point of 170° C. or lower as the starting compound. In the starting bisphenol compound, the substituent at the ortho-position with respect to the phenolic hydroxyl group is preferably a group other than a tertiary alkyl group.

Specific but non-limiting examples of these salicylic acid compounds are 2,2-bis(3-carboxy-4-hydroxy-5-sec-butylphenyl)propane, 2,2-bis(3-carboxy-4-hydroxy-5-methylphenyl)propane, 2,2-bis(3-carboxy-4-hydroxy-5-isopropylphenyl)propane, 2,2-bis(3-carboxy-4-hydroxy-5-allylphenyl)propane, 2,2-bis(3-carboxy-4-hydroxyphenyl)butane, 2,2-bis(3-carboxy-4-hydroxyphenyl)octane, 1,1-bis(3-carboxy-4-hydroxyphenyl)-pentane, 1,1-bis(3-carboxy-4-hydroxyphenyl)heptane, 1,1-bis(3-carboxy-4-hydroxyphenyl)-2-ethylhexane, 1-[bis(3-carboxy-4-hydroxyphenyl)methyl]naphthalene, 2,2-bis(3-carboxy-4-hydroxyphenyl)-2-phenylethane, 1,1-bis(3-carboxy-4-hydroxy-5-allylphenyl)cyclohexane, 1,4-bis(3-carboxy-4-hydroxycumyl)benzene, 1,3-bis(3-carboxy-4-hydroxycumyl)benzene, etc., and metal salts thereof.

The salicylic acid compound of formula (I) wherein R is

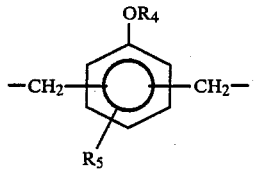

and $R_4$ is a hydrogen atom, or an organic residual group can be synthesized by subjecting the corresponding trisphenol compound to a Kolbe-Schmitt reaction.

Specific but non-limiting examples of these salicylic acid compounds are 2-(2-hydroxy-3-carboxy-4-t-octylphenyl)methyl-4-methyl-6-(2-hydroxy-3-methyl-5-methylphenyl)methylphenol, 2,6-bis[(2-hydroxy-3-carboxy-5-t-octylphenyl)methyl]-4-methylphenol, 2,6-bis[(2-hydroxy-3-carboxy-5-t-nonylphenyl)methyl]-4-methylphenol, 2,6-bis[(2-hydroxy-3-carboxy-5-methylphenyl)-methyl] -4-dodecylphenol, 2,6-bis[(2-hydroxy-3-carboxy-4-t-butylphenyl)methyl-4-t-amylphenol, 2-(2-hydroxy-3-carboxy-5-t-octylphenyl)methyl-4-methyl-6-(2-hydroxy-5-t-octylphenyl)methylphenol, 2-(2-hydroxy-3-carboxy-5-t-butylphenyl)methyl-4-t-octyl-6-(2-hydroxy-5-t-butylphenyl)methylphenol, 2-(2-hydroxy-3-carboxy-5-t-octylphenyl)methyl-4-methyl-6-(4-hydroxy-3,5-dimethylphenyl)-methylphenol, 2-(2-hydroxy-3-carboxy-5-methylphenyl)-methyl-4-methyl-6-(2-hydroxy-3,5-di-t-butylphenyl)-methylphenol, 1-ethoxy-2,6-bis(4-hydroxy-3-carboxy-5-methylphenylmethyl)-4-t-nonylbenzene, 1-methoxy-2,6-bis(4-hydroxy-3-carboxyphenylmethyl)-4-t-dodecylbenzene, 1-hexyloxy-2,4-bis(4-hydroxy-3-carboxy-5-methylphenylmethyl)-6-t-butylbenzene, 1-isoamyloxy-2,6-bis(4-hydroxy-3-carboxyphenylmethyl)-4-t-dodecylbenzene, 1-methoxy-2,6-bis(2-hydroxy-3-carboxy-5-t-octylphenylmethyl)-4-butylbenzene, 4-(2-ethylhexyloxy)3,5-bis(4-hydroxy-3-carboxyphenylmethyl)toluene, 4-dodecyloxy-3,5-bis(4-hydroxy-3-carboxyphenylmethyl)toluene, 4-dodecyloxy-3,5-bis(4-hydroxy-3-carboxyphenylmethyl)toluene, 4-pentadecyloxy-3,5-bis(4-hydroxy-3-carboxyphenylmethyl)toluene, 4-octadecyloxy-3,5-bis(4-hydroxy-3-carboxyphenylmethyl)toluene, 4-(10-phenoxydecyloxy)-3,5-bis(4-hydroxy-3-carboxyphenylmethyl)toluene, 4-(2-o-chlorophenoxyethoxy)-3,5-bis(4-hydroxy- 3-carboxyphenylmethyl)toluene, 4-(2-p-t-dodecylphenoxyethoxy)-3,5-bis(4-hydroxy-3-carboxyphenylmethyl)-toluene, 4-[2-(2,4-di-t-amylphenoxy)ethoxy]-3,5-bis(4-hydroxy-3-carboxyphenylmethyl)toluene, 4-(2-p-t-octylphenoxy)ethoxy-3,5-bis(4-hydroxy-3-carboxyphenylmethyl)-toluene, 4-benzyloxy-3,5-bis(4-hydroxy-3-carboxyphenylmethyl)toluene, 4-phenethyloxy-3,5-bis(4-hydroxy-3-carboxyphenylmethyl)toluene, 4-(2-phenoxypropoxy)-3,5-bis(4-hydroxy-3-carboxyphenylmethyl)-toluene, and metal salts thereof.

The above-described salicylic acid compounds and their salts may be used either individually or in combination thereof.

The color developer according to the present invention may be used in combination with other known color developers, such as salicylic acid compounds other than those of the present invention, phenol compounds, phenol resins, acid clay, bentonite, novolak resins, metal-treated novolak resins, metal chelates, and the like.

Illustrative examples of these color developers include phenol compounds, e.g., 4-t-butylphenol, 4-phenylphenol, 4-hydroxydiphenoxide, α-naphthol, β-naphthol, hexyl 4-hydroxybenzoate, 2,2'-dihydroxybiphenyl, 2,2'-bis(4-hydroxyphenyl)propane (bisphenol A), 4,4'-isopropylidenebis(2-methylphenol), 1,1-bis(3-chloro-4-hydroxyphenyl)cyclohexane, 1,1-bis(3-chloro-4-hydroxyphenyl)-2-ethylbutane, 4,4'-sec-isooctylidenediphenol, 4-t-octylphenol, 4,4'-sec-butylidenediphenol, 4-p-methylphenylphenol, 4,4'-isopentylidenediphenol, 4,4'-methylcyclohexylidenediphenol, 4,4'-dihydroxydiphenyl sulfide, 1,4-bis(4'-hydroxycumyl)benzene, 1,3-bis(4'-hydroxycumyl)benzene, 4,4'-thiobis(6-t-butyl-3-methylphenol), 4,4'-dihydroxydiphenylsulfone, hydroquinone monobenzyl ether, 4-hydroxybenzophenone, 2,4-dihydroxybenzophenone, polyvinylbenzyloxycarbonylphenol, 2,4,4'-trihydroxybenzophenone, 2,2',4,4'-tetrahydroxybenzophenone, dimethyl 4-hydroxyphthalate, methyl 4-hydroxybenzoate, 2,4,4'-trihydroxydiphenylsulfone, 1,5-bis-p-hydroxyphenylpentane, 1,6-bis-p-hydroxyphenoxyhexane, tolyl 4-hydroxybenzoate, α-phenylbenzyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, benzyl 4-hydroxybenzoate, m-chlorobenzyl 4-hydroxybenzoate, β-phenethyl 4-hydroxybenzoate, 4-hydroxy-2',4'-dimethyldiphenylsulfone, β-phenethyl orsellinate, cinnamyl orsellinate, o-chlorophenoxyethyl orsellinate, o-ethylphenoxyethyl orsellinate, o-phenylphenoxyethyl orsellinate, m-phenylphenoxyethyl orsellinate, β-3'-t-butyl- 4'-hydroxyphenoxyethyl 2,4-dihydroxybenzoate, 1-t-butyl-4-p-hydroxyphenylsulfonyloxybenzene, 4-N-benzylsulfamoylphenol, β-phenoxyethyl 2,4-dihydroxybenzoate, benzyl 2,4-dihydroxy-6-methylbenzoate, methyl bis-4-hydroxyphenylacetate, ditolylthiourea, and 4,4'-diacetyldiphenylthiourea, etc.; and salicylic acid compounds, e.g., 3-phenylsalicylic acid, 3-cyclohexylsalicylic acid, 3,5-di-t-butylsalicylic acid, 3-methyl-5-benzylsalicylic acid, 2-phenyl-5-(α,α-dimethylbenzyl)-salicylic acid, 3,5-di-(α-methylbenzyl)salicylic acid, 5-t-octylsalicylic acid, 3-chloro-5-cumylsalicylic acid, 3-methyl-5-t-octylsalicylic acid, 3-methyl-5-α-methyl-benzylsalicylic acid, 3-methyl-5-cumylsalicylic acid, 3,5-di-t-amylsalicylic acid, 3-phenyl-5-benzylsalicylic acid, 3-phenyl-5-t-octylsalicylic acid, 3-phenyl-5-α-methylbenzylsalicylic acid, 3,5-di-t-octylsalicylic acid, 3,5-bis(α-methylbenzyl)salicylic acid, 3,5-dicumylsalicylic acid, 4-methyl-5-(α-methylbenzyl)-salicylic acid, 4-methyl-5-cumylsalicylic acid, 3-(α-methylbenzyl)-6-methylsalicylic acid, 3-(α-methylbenzyl)-6-phenylsalicylic acid, 3-triphenylmethylsalicylic acid, 3-diphenylmethylsalicylic acid, 4-n-dodecylsalicylic acid, 4t-dodecylsalicylic acid, 4-n-pentadecylsalicylic acid, 4-n-heptadecylsalicylic acid, 5-(1,3-diphenylbutyl)salicylic acid, 5-n-octadecylsalicylic acid, 5-dodecylsulfonylsalicylic acid, 5-dodecylsulfosalicylic acid, 3-methyl-5-dodecylsulfosalicylic acid, etc.

The above-illustrated other known color developers may be used either individually or in combination of two or more. Of these color developers, it is preferred to use salicylic acid compounds, particularly 3,5-bis(α-methylbenzyl)salicylic acid, in any such combination.

The color developers are preferably used in the present invention in a total amount of from 50 to 5,000% by weight, more preferably from 100 to 2,000% by weight, based on the weight of the color formers. The salicylic acid compounds of formula (I) according to the present invention are preferably used in combination with from 10 to 200% by weight of the above-described other known color developers. Further, when combined with the known color developers, the salicylic acid compounds of formula (I) are preferably used in an amount of at least 10% by weight, more preferably at least 20% by weight, based on the total weight of the color developer.

The color formers which can be used in the present invention include triphenylmethane phthalide compounds, fluoran compounds, phenothiazine compounds, indolylphthalide compounds, leuto-auramine compounds, rhodamine-lactam compounds, triphenylmethane compounds, triazine compounds, spiropyran compounds, fluorene compounds, pyradine compounds, pyrazine compounds, and the like.

Specific examples of the phthalide compounds are described, e.g., in U.S. Reissure Pat. No. 23,024, and U.S. Pat Nos. 3,491,111, 3,491,112, 3,491,116, and 3,509,174. Specific examples of the fluoran compounds are described, e.g., in U.S. Pat Nos. 3,624,107, 3,627,787, 3,641,011, 3,462,828, 3,681,390, 3,920,510, and 3,959,571. Specific examples of the spirodipyran compounds are described, e.g., in U.S. Pat. No. 3,971,808. Specific examples of pyridine and pyrazine compounds are described, e.g., in U.S. Pat. Nos. 3,775,424, 3,853,869, and 4,246,318. Specific examples of the fluorene compounds are described in JP-A-63-94878.

Illustrative, non-limiting examples of these color formers are given below.

The triarylmethane color former compounds include 3,3-bis(p-diemthylaminophenyl)-6-dimethylaminophthalide (i.e., Crystal Violet Lactone), 3,3-bis(p-dimethylaminopheny)phthalide, 3-(4-diethylaminophenyl-2-ethoxyphenyl)-3-(1-octyl-2-methylindol-3-yl)phthalide, 3-(4-diethylamino-2-ethoxyphenyl)-3-(1-ethyl-2-methylindol-3-yl)phthalide, etc.

The diphenylmethane color former compounds include 4,4'-bis-dimethylaminobenzhydrin benzyl ether, an N-halophenyl-leucoauramine, N-2,4,5-trichlorophenylleucoauramine, etc.

The rhodamine-lactam and fluoran color former compounds include Rhodamine-B-anilinolactam, 3-diethylamino-7,8-benzofluoran, Rhodamine (p-nitrilino)-lactam, Rhodamine B (p-chloroanilino)lactam, 2-(benzylamino)-6-diethylaminofluoran, 2-anilino-6-diethylaminofluoran, 2-anilino-3-methyl-6-diethylaminofluoran, 2-anilino-3-methyl-6-cyclohexyl-N-methylaminofluoran, 2-o-chloroanilino-6-diethylaminofluoran, 2-(m-chloroanilino)-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trifluoromethylanilino-6-diethylaminofluoran, 2-butylamino-3-chloro-6-diethylaminofluoran, 2-ethoxyethylamino-3-chloro-6-diethylaminofluran, 2-p-chloroanilino-3-methyl-6-dibutylaminofluoran, 2-anilino-3-methyl-6-dioctylaminofluoran, 2-anilino-3-chloro-6-diethylaminofluoran, 2-diphenylamino6-diethylaminofluoran, 2-anilino-3-methyl-6-diphenylaminofluoran, 2-phenyl-6-diethylaminofluoran, 2-anilino-3-methyl-6-N-ethyl-N-isoamylaminofluoran, 2-anilino-3-methyl-5-chloro-6-diethylaminofluoran, 2-anilino-3-methyl- 6-diethylamino-7-methylfluoran, 2-anilino-3-methoxy-6-dibutylaminofluoran, 2-o-chloroanilino-6-dibutylaminofluoran, 2-p-chloroanilino-3-ethoxy-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-methyl-4',5'-dichlorofluoran, etc.

The indolylphthalide color former compounds include 3,3-bis(1-ethyl-2-methylindol-3-yl)phthalide, 3,3-bis(1-octyl-2-methylindol-3-yl)phthalide, 3-(2-ethoxy-4-diethylaminophenyl)-3-(1-ethyl-2-methylindol-3-yl)phthalide, 3-(2-ethoxy-4-dibutylaminophenyl)-3-(1-ethyl-2-methylindol-3-yl)phthalide, 3-(2-amyloxy-4-diethylaminophenyl)-3-(1-ethyl-2-methylindol-3-yl)phthalide, 3-(2-ethoxy-4-diethylaminophenyl)-3-(1-octyl-2-methylindol-3-yl)phthalide, etc.

The pyridine color former compounds include 3-(2-ethoxy-4-diethylaminophenyl)-3-(1-octyl-2-methylindol-3-yl)-4- or 7-azaphthalide, 3-(2-ethoxy-4-diethylaminophenyl)-3-(1-ethyl-2-methylindol-3-yl)-4- or 7-azaphthalide, 3-(2-hexyloxy-4-diethylaminophenyl)-3-(1-ethyl-2-methylindol-3-yl)-4- or 7-azaphthalide, 3-(2-ethoxy-4-diethylaminophenyl)-3-(1-ethyl-2-phenylindol-3-yl)-4- or 7-azaphthalide, 3-(2-butyoxy-4-diethylaminophenyl)-3-(1-ethyl-2-phenylindol-3-yl)-4- or 7-azaphthalide, 3-(2-ethoxy-4-diethylaminophenyl)-3-(1-octyl-2-phenylindol-3-yl)-4- or 7-azaphthalide, etc.

The fluorene color former compounds include 3',6'-bisdiethylamino-5-diethylaminospiro(isobenzofuran-1,9'-fluorene)-3-one, 3',6'-bisdiethylamino-7-diethylamino-2-methylspiro(1,3-benzoxazine-4,9'-fluorene), 3',6'-bisdiethylamino-7-diethylaminospiro(2-hydro-1,3-benzoxazine-4,9'-fluorene)-2-one, etc.

In the recording materials according to the present invention, a polar solvent may be used. Examples of such a polar solvent preferably include those having a polar group (such as, ester, amido, carbonyl, hydroxyl, or a halogen atom). Of these, the most preferred polar solvents are those having low water solubility, particularly a water solubility of not more than 10% by weight at room temperature. Such a polar solvent may be incorporated in microcapsules either individually or together with the color former, or may be incorporated into a color developer sheet. When incorporated into microcapsules, the polar solvent may be used either alone or in combination with other solvents, such as aromatic hydrocarbons, chlorinated paraffin, paraffin oil, etc. It is particularly preferred to use the polar solvent in combination with an aromatic hydrocarbon (e.g., an alkylated biphenyl, a diarylalkane, an alkylated naphthalene) and/or isoparaffin. In this combined use, the proportion of the polar solvent in the total solvent preferably ranges from 1 to 50% by weight from the viewpoint of color developability and image preservability.

Specific, non-limiting examples of the above-described polar solvent are butyl ether, 3-pentanone, ethyl acetate, propyl acetate, butyl acetate, isopentyl acetate, methyl benzoate, ethyl benzoate, benzyl benzoate, ethyl carbonate, ethyl oxalate, ethyl phthalate, butyl phthalate, octyl phthalate, butyl phosphate, 1,2-di-chloroethane, 1,1,1-trichloroethane, N,N-dibutylacetamide, N,N-dibenzylacetamide, methyl phthalate, butyl oleate, butyl adipate, diethylene glycol dibenzoate, triethylene glycol dibenzoate, acetyltriethyl citrate, etc.

The amount of the polar solvent to be used preferably ranges from 5 to 3,000% by weight, more preferably from 7 to 2,000% by weight, based on the color developer.

The color former and salicylic acid compounds of formula (I) can be used in the recording materials in the form of a fine dispersion, fine droplets, or films.

The recording materials according to the present invention are characterized in that the developed color image exhibits marked stability. This effect is particularly outstanding in pressure-sensitive recording materials and heat-sensitive recording materials.

The pressure-sensitive recording materials to which the present invention is applied embrace various embodiments of form as described, e.g., in U.S. Pat. Nos. 2,505,470, 2,505,471, 2,505,489, 2,548,366, 2,712,507, 2,730,456, 2,730,347, 3,103,404, 3,418,250, and 4,010,038. The most commonly employed form of pressure-sensitive recording materials is comprised of at least one pair of sheets, each of which separately contains a color former and a color developer, respectively.

Methods for encapsulizing the color former include a method utilized coacervation of a hydrophilic colloid sol as described in U.S. Pat. Nos. 2,800,457 and 2,800,458, an interfacial polymerization method as described in British Pat. Nos. 867,797, 950,443, 989,264, and 1,091,076, and the method disclosed in U.S. Pat. No. 3,103,404.

In general, the color former or a mixture of color formers is dissolved in a solvent, such as a synthetic oil (e.g., an alkylated naphthalene, an alkylated biphenyl, an alkylated diphenylmethane, an alkylated terphenyl, a chlorinated paraffin, etc.), a vegetable oil (e.g., cotton seed oil, castor oil, etc.), an animal oil, a mineral oil, and mixtures thereof, and, if desired, the above-described polar solvent. The solution is incorporated into microcapsules, and the microcapsule dispersion is coated on a support, such as paper, fine paper, a plastic sheet, resin-coated paper, etc., to obtain a color former sheet.

On the other hand, the color developer or a mixture of color developers is dispersed in a binder, e.g., a styrene-butadiene latex, polyvinyl alcohol, etc., and the dispersion is coated on a support, e.g., paper, a plastic sheet, resin-coated paper, etc., together with pigments hereinafter described to obtain a color developer sheet.

The amounts of the color former and the color developer to be used can be selected appropriately depending on various conditions, such as the desired coating thickness, the form of the pressure-sensitive recording material, the method for encapsulizing, and the like. Such selection can be made easily by one skilled in the art.

The heat-sensitive recording materials to which the present invention is applied include various embodiments of form as described in JP-A-62-144989 and Japanese patent application No. 62-244883. In more detail, each of the color former and the color developer is pulverized and dispersed in a dispersing medium to a particle size of 10 μm or less, preferably 3 μm or less. The dispersing medium usually includes an aqueous solution of a water-soluble high polymer in a concentration of from about 0.5 to 10% by weight. The dispersing can be carried out by means of a ball mill, a sand mill, a horizontal sand mill, an attritor, a colloid mill, etc.

The weight ratio of the color former to color developer preferably ranges from 1:10 to 1:1, and more preferably from 1:5 to 2:3.

The color former or color developer is preferably used in combination with a heat-fusible compound having a melting point of from 75° C. to 130° C., such as (a) nitrogen-containing organic compounds, e.g., fatty acid amides (e.g., stearamide), acetoacetanilide, diphenylamine, benzamide, stearylureastearic acid anilide, carbazole, etc.; (b) 2,3-di-m-tolylbutane, (c) o-fluorobenzoyldurene, (d) chlorobenzoylmesitylene, (e) 4,4'-dimethylbiphenyl; (f) carboxylic acid esters, e.g., dimethyl isophthalate, diphenyl phthalate, dimethyl terephthalate, metacryloxybiphenyl, etc.; and (g) ether compounds, e.g., di-m-tolyloxyethane, 2-benzyloxynaphthalene, 1,2-diphenoxyethane, 1,2-bis-m-tolyloxyethane, 1-phenoxy-2-p-chlorophenoxyethane, β-phenethyloxy-p-biphenyl, β-phenoxyethoxyanisole, 1-phenoxy-2-p-ethylphenoxyethane, bis-β-(p-methoxyphenoxy)ethoxymethane, 1-2'-methylphenoxy-2''-ethylphenoxyethane, 1-tolyloxy-2-p-methylphenoxyethane, 1,2-diphenoxyethane, 1,4-diphenoxybutane, bis-β-(p-ethoxyphenoxy)ethyl ether, 1-phenoxy-2-p-chlorophenoxyethane, 1,2'-methylphenoxy-2-4''-ethyloxyphenoxyethane, 1-4'-methylphenoxy-2-4''-fluorophenoxyethane, etc. The preferred heat-fusible compounds are those having an amido linkage. These compounds are used in the form of a fine dispersion together with either the color former or the color developer. From the standpoint of fog prevention, it is particularly preferable that these heat-fusible compounds are dispersed together with the color former. The heat-fusible compound is added in an amount of from 20 to 300% by weight, and preferably from 40 to 150% by weight, based on the color developer.

The coating composition for the recording layer preferably further contains other additives for meeting various requirements. For example, in order to prevent contamination of a recording head, an inorganic pigment or an oil-absorbing substance, such as a polyurea filler, can be incorporated into a binder. Further, in order to improve release of the sheet from the recording head, a fatty acid, a metallic soap, etc. can be added to the coating composition. Thus, the coating composition usually comprises, in addition to the color former and color developer which directly take part in color formation, a pigment, a wax, an antistatic agent, an ultraviolet absorbent, a defoaming agent, a conductive agent, a fluorescent dye, a surface active agent, a hindered phenol, and the like.

Specific examples of the above-mentioned pigment are kaolin, calcined kaolin, talc, agalmatolite, diatomaceous earth, calcium carbonate, aluminum hydroxide, magnesium hydroxide, calcined gypsum, silica, magnesium carbonate, titanium oxide, alumina, barium carbonate, barium sulfate, mica, microballoon, a urea-formalin filler, polyethylene particles, a cellulose filler, and the like. These pigments preferably have a particle size of from 0.1 to 15 μm.

Specific examples of the above-mentioned wax are paraffin wax, carboxyl-modified paraffin was, carnauba wax, microcrystalline wax, polyethylene wax, higher fatty acid esters, etc.

The above-mentioned metallic soaps include higher fatty acid polyvalent metal salts, e.g., zinc stearate, aluminum stearate, calcium stearate, zinc oleate, etc.

The above-mentioned hindered phenol preferably includes phenol compound wherein at least one of the 2- and 6-position is substituted with a branched alkyl group. Specific examples of such hindered phenols are 1,1,3-tris(2-methyl-4-hydroxy-5-t-butylphenyl)butane, 1,1,3-tris(2-ethyl-4-hydroxy-5-t-butylphenyl)butane, 1,1,3-tris(3,5-di-t-butyl-4-hydroxyphenyl)butane, 1,1,3-tris(2-methyl-4-hydroxy-5-t-butylphenyl)propane, 2,2'-methylenebis(6-t-butyl-4-methylphenol), 2,2'-methylene-bis(6-t-butyl-4-ethylphenol), 4,4'-butylidenebis(6-t-butyl-3-methylphenol), 4,4'-thiobis(3-methyl-6-t-butylphenol), stearyl β-(4-hydroxy-3,5-di-t-butylphenyl)-propionate, 1,5-bis[β-(4-hydroxy-3,5-di-t-butylphenyl)-ethylcarbonyloxy]-3-thiapentane, etc. The hindered phenol is preferably used in an amount of from 1 to 200% by weight, more preferably 5 to 50% by weight, based on the color developer.

The above-mentioned additives are dispersed in a binder. The binder to be used is generally water-soluble and includes polyvinyl alcohol, hydroxyethyl cellulose, hydroxypropyl cellulose, epichlorohydrin-modified polyamide, an ethylene-maleic anhydride co-polymer, a styrene-maleic anhydride copolymer, an isobutylene-maleic anhydride copolymer, polyacrylic acid, polyacrylamide, methylol-modified polyacrylamide, starch derivatives, casein, gelatin, and the like. For the purpose of imparting water resistance to the binder, a water resistance-imparting agent, such as a gelling agent and a crosslinking agent, or an emulsion of a hydrophobic polymer, such as a styrene-butadiene rubber latex, an acrylic resin emulsion, etc., may be added to the binder. The coating composition thus prepared is coated on a support, e.g., paper, fine paper, synthetic paper, a plastic sheet, neutral paper, etc., to a coverage of from about 2 to 10 g/m$^2$.

If desired, a protective layer having a thickness of from about 0.2 to 2 μm may be provided on the recording layer to ensure durability. The protective layer preferably comprises a water-soluble or water-dispersible high polymer, such as polyvinyl alcohol, hydroxyethyl starch, epoxy-modified polyacrylamide, etc., and a crosslinking agent. If desired, the protective layer may be comprised of two or more layers.

For the purpose of correcting curling of the support or improving chemical resistance, a backing layer having a composition similar to the protective layer may be provided on the back side of the support. In a special embodiment of the present invention, the recording material can be combined with a release paper, with an adhesive layer between the support and the release paper, to produce a label.

The heat-sensitive recording material may also have structures disclosed in German Offenlegungsschrift (OLS) Nos. 2,228,581 and 2,110,854, and JP-B-52-20142. If necessary, the heat-sensitive recording material may be subjected to pretreatment, such as preheating, moisture conditioning, stretching, and the like, prior to recording.

The electric heat-sensitive recording materials to which the present invention is applicable can be produced in accordance with the methods disclosed, e.g., in JP-A-49-11344 and JP-A-50-48930. In general, a conductive material, a basic dye mainly comprising the color former, and a color developer are dispersed in a binder to prepare a coating composition, and the coating composition is coated on a support, such as paper. Alternatively, a conductive substance is coated on a support to form a conductive layer, and then a coating composition comprising a binder having dispersed therein a color former and a color developer is coated thereon. The above-described heat-fusible compound may be incorporated into the coating composition to improve sensitivity.

The light- and pressure-sensitive recording materials of the present invention can be produced according to the methods described, e.g., in JP-A-57-179836. In general, a color former, a photo-polymerization initiator (e.g., silver iodobromide, silver bromide, silver behenate, Michler's ketone, benzoin derivatives, benzophenone derivatives), a polyfunctional monomer (e.g., a polyallyl compound), and a crosslinking agent (e.g., poly(meth)acrylate, poly(meth)acrylamide), and, if necessary, a solvent are incorporated into microcapsules made of a synthetic resin (e.g., polyether-urethane, polyurea). Recording on the light- and pressure-sensitive recording materials of the present invention can be performed by imagewise exposing the recording material to light and then bringing the color former in the unexposed areas into contact with a color developer to develop a color.

The present invention is now illustrated in greater detail with reference to Examples, but it should be understood that the present invention is not deemed to be limited thereto. In these examples, all the parts and percents are by weight unless otherwise indicated.

EXAMPLES 1 TO 4

Preparation of Color Former-Containing Microcapsule Sheet:

Five parts of a partial sodium salt of polyvinylbenzenesulfonic acid ("VERSA TL500" produced by National Starch Inc.) were dissolved in 95 parts of hot water, and the solution was cooled. The solution was adjusted to a pH of 4.0 with an aqueous solution of soldium hydroxide.

A hundred parts of diisopropylnaphthalene having dissolved therein Crystal Violet Lactone (CVL) in a concentration of 3.5% were dispersed in 100 parts of the above-prepared 5% aqueous solution of Versa TL500 to obtain an emulsion having a particle size of 4.0 μm.

Separately, a mixture of 6 parts of melamine, 11 parts of a 37% formaldehyde aqueous solution, and 30 parts of water was stirred under heating at 60° C. for 30 minutes to prepare a clear aqueous solution containing melamine, formaldehyde, and an initial condensate of melamine and formaldehyde.

The resulting aqueous solution was mixed with the above-prepared emulsion, and the mixture was adjusted to a pH of 6.0 with a 2M phosphoric acid solution while stirring. The mixture was heated to 65° C., at which temperature the stirring was continued for an additional period of 6 hours. The resulting capsule dispersion was cooled to room temperature, and adjusted to a pH of 9.0 with a sodium hydroxide aqueous solution.

To the capsule dispersion were added 200 parts of a 10% aqueous solution of polyvinyl alcohol and 50 parts of starch particles, and water was added to make a coating composition in the form of a microcapsule dispersion having a solids content of 20%.

The coating composition was coated with an air knife coater on paper having a basis weight of 50 g/m$^2$ to a solid coverage of 5 g/m$^2$, followed by drying to obtain a color former-containing capsule sheet.

Preparation of Color Developer Sheet:

A mixture consisting of 10 parts of each of the color developers shown in Table 1, 20 parts of Silton clay, 60 parts of calcium carbonate, 20 parts of zinc oxide, 1 part of sodium hexamethaphosphate, and 200 parts of water, was dispersed in a sand grinder to an average particle size of 3 μm.

To the dispersion were added 16 parts of a 10% polyvinyl alcohol (PVA) aqueous solution, 100 parts of a 10% PVA aqueous solution, and 10 parts (solid basis) of a carboxyl-modified styrene-butadiene-rubber (SBR) latex, and water was added thereto to prepare a coating composition having a solids content of 20%.

The coating composition was coated on paper having a basis weight of 50 g/m$^2$ to a solid content of 5.0 g/m$^2$ with an air knife coater, followed by drying to obtain a color developer sheet.

COMPARATIVE EXAMPLE 1

A color developer sheet was prepared in the same manner as in Example 1, except that the color developer used in Example 1 was replaced with zinc 3,5-bis-α-methylbenzylsalicylate shown in Table 1.

Each of the recording materials obtained in Examples 1 to 4 and in the Comparative Example was evaluated in accordance with the following test method, and the results obtained are shown in Table 1.

(1) Color Developability:

The color former-containing microcapsule sheet was brought into contact with each of the color developer sheets obtained in the foregoing Examples and in the Comparative Example, and a load of 600 kg/cm$^2$ was applied thereon. The density of the thus developed color image at 610 nm was measured by means of a Hitachi Color Analyzer Model 307 to evaluate color develop-ability at a time 10 minutes after the time of color formation.

(2) Light-Fastness:

The color image as developed in (1) above after 10 minutes from the time of color formation, was exposed to light for 4 hours in a fluorescent lamp fadeometer (33,000 lux). The density of the color image after the exposure was measured. The ratio of the density after the exposure to that before the exposure was taken as an indication of light-fastness.

(3) Resistance to Plasticizer:

The color image as developed in (1) above after 10 minutes from the time of color formation, was brought into contact with a 0.5 mm thick sheet made of soft polyvinyl chloride containing 15 wt % of dibutyl phthalate and 7 wt % of dioctyl phthalate as plasticizers, and allowed to stand at 50° C. and 20% relative humidity (RH) for 72 hours with a load of 100 g/cm$^2$ being applied thereon. The density of the color image after the standing test under load was measured. The ratio of this density to the density before the test was taken as an indication of resistance to plasticizer.

TABLE 1

| Example No. | Color Developer | Color Developability | Light Fastness | Resistance to Plasticizer |
|---|---|---|---|---|
| Example 1 | Zn salt of Compound (2) | 0.96 | 0.79 | 0.75 |
| Example 2 | Zn salt Compound (4) | 0.98 | 0.78 | 0.73 |
| Example 3 | Zn salt Compound (7) | 0.97 | 0.80 | 0.76 |
| Example 4 | Equal weight mixture of Zn salt of Compound (2) and zinc 3,5-bis-α-methylbenzylsalicylate | 1.00 | 0.81 | 0.73 |
| Comparative Example | Zinc 3,5-bis-α-methylsalicylate | 1.01 | 0.82 | 0.40 |

As can be seen from Table 1, the color developer sheets according to the present invention are superior to the comparative sample in resistance of the color image to plasticizers.

EXAMPLE 5

Each of an equal weight mixture of (i) 2-anilino-3-chloro-6-diethylaminofluoran and 2-anilino-3-methyl-6-N-ethyl-N-isoamylaminofluoran as the color former, (ii), Compound (2) as the color developer, and (iii) stearamide, each of (i), (ii) and (iii) weighing 20 g, was poured into 100 g of a 5% aqueous solution of PVA ("Kuraray PVA-105") while stirring. After thoroughly defoaming, each of mixtures (i), (ii) and (iii) was dispersed in a sand mill ("Dynomill KDL" manufactured by WEB Co.) to a volume average particle size of not greater than 3 μm to prepare (i) a color former-containing dispersion, (ii) a color developer-containing dispersion, and (iii) a stearamide-containing dispersion.

Separately, 80 g of an equal weight mixture of calcium carbonate and zinc oxide as pigment and 160 g of a 0.5% aqueous solution of sodium hexametaphosphate were dispersed in a homogenizer to form a pigment-containing dispersion.

Five grams of (i) the color former-containing dispersion, 10 g of the color developer-containing dispersion, 5 g of the stearamide-containing dispersion, and 22 g of the pigment-containing dispersion were mixed. To the mixture were added 4 g of a zinc stearate emulsion and 5 g of a 2% aqueous solution of sodium (2-ethylhexyl)-sulfosuccinate to prepare a coating composition.

The resulting coating composition was coated on fine paper having a basis weight of 50 g/m$^2$ with a wire bar to a dry coverage of 7 g/m$^2$, dried in an oven at 50° C., and subjected to calendering to obtain a heat-sensitive recording material.

When recording was effected on the recording material by means of a high-speed facsimile ("FF-2000" manufactured by Fujitsu Ltd.), a black image was developed. This color image proved excellent in light-fastness and chemical resistance.

EXAMPLE 6

Preparation of Color Former-Containing Microcapsule Sheet:

Five parts of a partial sodium salt of polyvinylbenzenesulfonic acid ("VERSA TL500") were dissolved in 95 parts of hot water, and the solution was cooled. The solution was adjusted to a pH of 4.0 with an aqueous solution of sodium hydroxide.

A hundred parts of diisopropylnaphthalene having dissolved therein 3-(2-ethoxy-4-diethylaminophenyl)-3-(1-octyl-2-methylindol-3-yl)phthalide in a concentration of 4.5% were dispersed in 100 parts of the above-prepared 5% aqueous solution of VERSA TL500 to obtain an emulsion having a particles size of 4.0 μm.

Separately, a mixture of 6 parts of melamine, 11 parts of a 37% formaldehyde aqueous solution, and 30 parts of water, was stirred under heating at 60° C. for 30 minutes to prepare a clear aqueous solution containing an initial condensate of melamine and formaldehyde.

The resulting aqueous solution was mixed with the above-prepared emulsion, and the mixture was adjusted to a pH of 6.0 with a 2M phosphoric acid solution while stirring. The mixture was heated to 65° C., at which temperature the stirring was continued for an additional period of 6 hours. The resulting capsule dispersion was cooled to room temperature, and adjusted to a pH of 9.0 with a sodium hydroxide aqueous solution.

To the capsule dispersion were added 200 parts of a 10% aqueous solution of polyvinyl alcohol and 50 parts of starch particles, and water was added to make a coating composition in the form of a microcapsule dispersion having a solids content of 20%.

The coating composition was coated with an air knife coater on paper having a basis weight of 50 g/m$^2$ to a solid coverage of 5 g/m$^2$, followed by drying to obtain a color former-containing capsule sheet.

Preparation of Color Developer Sheet:

A mixture consisting of 7 parts of 2,2-bis(3-carboxy-4-hydroxy-5-sec-butylphenyl)propane, 7 parts of 3,5-bis-(α-methylbenzyl)salicylate as the color developer, 80 parts of calcium carbonate, 20 parts of zinc oxide, 1 part of sodium hexamethaphosphate, and 200 parts of water was dispersed in a sand grinder to an average particle size of 3 μm.

To the dispersion were added 100 parts of a 10% PVA aqueous solution, and 10 parts (solid basis) of a carboxyl-modified SBR latex, and water was added thereto to prepare a coating composition having a solids content of 20%.

The coating composition was coated on paper having a basis weight of 50 g/m$^2$ to a solid content of 5.0 g/m$^2$ with an air knife coater, followed by drying to obtain a color developer sheet.

The color former-containing microcapsule sheet and the color developer sheet were brought into contact, and a load of 600 kg/cm$^2$ was applied thereon to obtain a blue image on the color developer sheet.

A 0.5 mm thick sheet made of soft polyvinyl chloride (PVC) containing 15% of dibutyl phthalate and 7% of dioctyl phthalate, was superposed on the developed color image, and the sheets were allowed to stand at 50° C. and 20% RH for 10 days under a load of 100 g/cm$^2$. As a result, neither discoloration nor marring of the color image was observed.

EXAMPLE 7

A color developer sheet was obtained in the same manner as in Example 6, except that the color formers used in Example 6 were replaced with 6 parts of 1,1-bis(3-carboxy-4-hydroxyphenyl)-2-ethylhexane and 8 parts of zinc 3,5-bis(α-methylbenzyl)salicylate.

When a color image was developed on the color developer sheet and then contacted with a soft PVC sheet in the same manner as in Example 6, neither discoloration nor marring of the color image was observed.

EXAMPLE 8

A color developer sheet was obtained in the same manner as in Example 6, except for using 7 parts of a zinc salt of 2-(2-hydroxy-3-carboxy-5-t-octylphenyl)-methyl-4-methyl-6-(2-hydroxy-5-t-octylphenyl)methyl-phenol and 7 parts of zinc 3,5-bis(α-methylbenzyl)salicylate as the color formers.

When a color image was developed on the color developer sheet and then contacted with a soft PVC sheet in the same number as in Example 6, neither discoloration nor marring of the color image was observed.

EXAMPLE 9

A color developer sheet was obtained in the same manner as in Example 6, except for using 6 parts of 2,6-bis[ (2-hydroxy-3-carboxy-5-t-octylphenyl)methyl]-4-methylphenol and 8 parts of zinc 3,5-bis(α-methylbenzyl)-salicylate as the color formers.

When a color image was developed on the color developer sheet and then contacted with a soft PVC sheet in the same manner as in Example 6, neither discoloration nor marring of the color image was observed.

EXAMPLE 10

Preparation of Color Former-Containing Microcapsule Sheet:

Five parts of a partial sodium salt of polyvinylbenzenesulfonic acid ("VERSA TL500") were dissolved in 95 parts of hot water, and the solution was cooled. The solution was adjusted to a pH of 4.0 with an aqueous solution of sodium hydroxide.

3-(2-Ethoxy-4-diethylaminophenyl)-3-(1-octyl-2-methylindol-3-yl)phthalide was dissolved in a mixed solvent consisting of 50 parts of diisopropylnaphthalene, 30 parts of paraffin oil, and 20 parts of butyl acetate in a concentration of 4.5%, and the solution was emulsified and dispersed in 100 parts of the above-prepared 5% aqueous solution of VERSA TL500 to obtain an emulsion having a particle size of 4.0 μm.

Separately, a mixture of 6 parts of melamine, 11 parts of a 37% formaldehyde aqueous solution, and 30 parts of water, was stirred under heating at 60° C. for 30 minutes to prepare a clear aqueous solution containing an initial condensate of melamine and formaldehyde.

The resulting aqueous solution was mixed with the above-prepared emulsion, and the mixture was adjusted to a pH of 6.0 with a 2M phosphoric acid solution while stirring. The mixture was heated to 65° C., at which temperature the stirring was continued for an additional period of 6 hours. The resulting capsule dispersion was cooled to room temperature, and adjusted to a pH of 9.0 with a sodium hydroxide aqueous solution.

To the capsule dispersion were added 200 parts of a 10% aqueous solution of PVA and 50 parts of starch particles, and water was added to make a coating composition in the form of a microcapsule dispersion having a solids content of 20%.

The coating composition was coated with an air knife coater on paper having a basis weight of 50 g/m$^2$ to a solid coverage of 5 g/m$^2$, followed by drying to obtain a color former-containing capsule sheet.

Preparation of Color Developer Sheet:

A color developer sheet was prepared in the same manner as in Example 6, except for using, as the color formers, 7 parts of a zinc salt of 4-(2-ethylhexyloxy-3,5-bis(4-hydroxy-3-carboxyphenyl)toluene and 7 parts of zinc 3,5-bis(α-methylbenzyl)salicylate.

A color image was developed on the color developer sheet and contacted with a soft PVC sheet in the same manner as in Example 6, Except that the sheet was allowed to stand under the load for 30 days. Neither discoloration nor marring of the color image was observed.

EXAMPLE 11

A color developer sheet was prepared in the same manner as in Example 6, except for using, as the color developers, 7 parts of a zinc salt of 4-(2-p-t-dodecyl-phenoxyethoxy)-3,5-bis(4-hydroxy-3-carboxyphenyl)-toluene and 8 parts of zinc 3,5-bis((α-methylbenzyl)-salicylate.

When a color image was developed on the color developer sheet and then contacted with a soft PVC sheet in the same manner as in Example 6, neither discoloration nor marring of the color image was observed.

While the invention has been described in detail and with reference to specific embodiments thereof, it will be apparent to one skilled in the art that various changes and modifications can be made therein without departing from the spirit and scope thereof.

What is claimed is:

1. A recording material comprising a support having thereon at least one electron donating colorless dye and at least one electron accepting compound, wherein the electron accepting compound is a salicylic acid compound represented by formula (I):

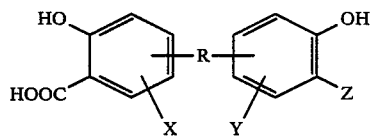

(I)

wherein R represents

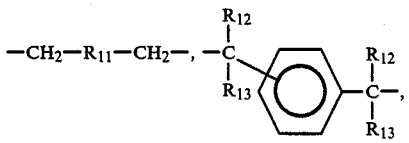

-continued

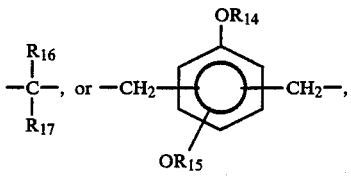

wherein $R_{11}$ represents

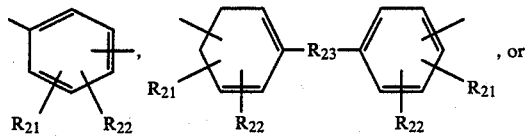

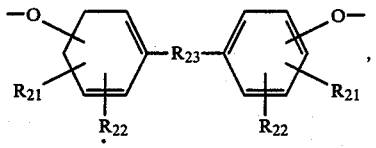

wherein $R_{21}$ and $R_{22}$, which may be the same or different, each represents a hydrogen atom, an alkyl group, an alkoxy group, a halogen atom, an aryl group, or a hydroxyl group; and $R_{23}$ represents an alkylene group or an aralkylene group; $R_{12}$ and $R_{13}$ each represents a hydrogen atom, an alkyl group, or an aryl group, provided that $R_{12}$ and $R_{13}$ do not simultaneously represent a hydrogen atom; $R_{16}$ and $R_{17}$ each represents a hydrogen atom, an alkyl group, or an aryl group, provided that at least one of them is an aryl group and that the sum of the carbon atom number of $R_{16}$ and $R_{17}$ is 7 or more; $R_{14}$ represents a hydrogen atom or an organic residual group; and $R_{15}$ represents a hydrogen atom, an alkyl group, an alkoxy group, or a halogen atom; X and Y, which may be the same or different, each represents a hydrogen atom, an alkyl group, an aryl group, an alkoxy group, or a halogen atom; and Z represents a hydrogen atom, a carboxyl group, an alkyl group, an aryl group, an alkoxy group, or a halogen atom, or a metal salt thereof.

2. A recording material as claimed in claim 1, wherein said salicylic acid compound is represented by formula (I'):

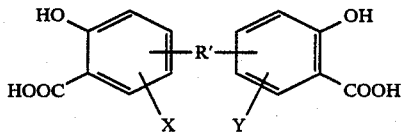

(I')

wherein X and Y, which may be the same or different, each represents a hydrogen atom, an alkyl group having from 1 to 18 carbon atoms, an alkoxy group having from 1 to 20 carbon atoms, a phenyl group, a chlorine atom, or a fluorine atom, and R' has the same definition as R.

3. A recording material as claimed in claim 2, wherein X and Y each represents a hydrogen atom, an alkyl group having from 1 to 18 carbon atoms, an alkoxy group having from 1 to 20 carbon atoms, a phenyl group, a chlorine atom, or a fluorine atom.

4. A recording material as claimed in claim 2, wherein R' is substituted in the meta-position with respect to the carboxyl group of the salicylic acid skeleton.

5. A recording material as claimed in claim 1, wherein $R_{11}$ is

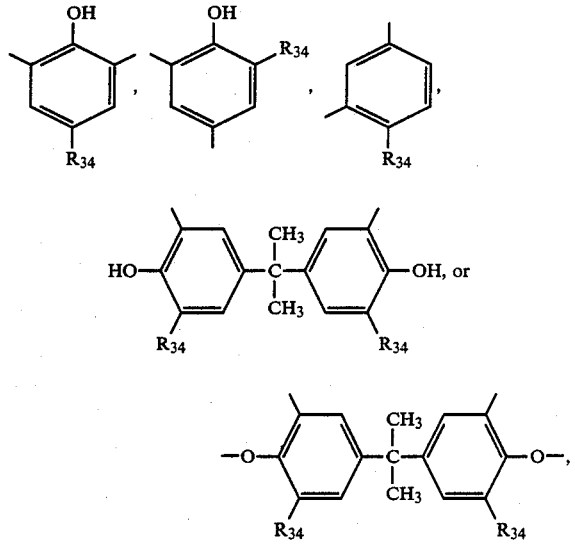

wherein $R_{34}$ represents a hydrogen atom, an alkyl group, an aryl group, or a halogen atom.

6. A recording material as claimed in claim 1, wherein $R_{12}$ and $R_{13}$ each represents a hydrogen atom, an alkyl group having from 1 to 8 carbon atoms, or an aryl group having from 6 to 12 carbon atoms, provided that $R_{12}$ and $R_{13}$ do not simultaneously represent a hydrogen atom.

7. A recording material as claimed in claim 1, wherein $R_{16}$ and $R_{17}$ each represents a hydrogen atom, an alkyl group having from 1 to 8 carbon atoms, or an aryl group having from 6 to 12 carbon atoms, provided that at least one of $R_{16}$ or $R_{17}$ is an aryl group and that the sum of the number of carbon atoms in $R_{16}$ plus the number of carbon atoms in $R_{17}$ is 7 or more.

8. A recording material as claimed in claim 1, wherein $R_{14}$ represents a hydrogen atom, a substituted or unsubstituted alkyl group having from 1 to 30 carbon atoms, or a substituted or unsubstituted aryl group having from 6 to 20 carbon atoms.

9. A recording material as claimed in claim 1, wherein $R_{14}$ represents a straight or branched alkyl group having from 1 to 20 carbon atoms, an aralkyl group, or an aryloxyalkyl group.

10. A recording material as claimed in claim 1, wherein $R_{15}$ represents a hydrogen atom, an alkyl group having from 1 to 18 carbon atoms, an alkoxy group having from 1 to 20 carbon atoms, a phenyl group, or a chlorine atom.

11. A recording material as claimed in claim 1, wherein said metal salt is a zinc salt, an aluminum salt, a magnesium salt, a calcium salt, a sodium salt, a nickel salt, or a cobalt salt.

12. A recording material as claimed in claim 1, wherein said salicylic acid has 26 or more carbon atoms.

13. A recording material as claimed in claim 1, wherein R is substituted in the meta-position with respect to the carboxyl group of the salicylic acid skeleton.

* * * * *